US005984049A

United States Patent [19]

Lammers

[11] Patent Number: 5,984,049

[45] Date of Patent: Nov. 16, 1999

[54] ROLL OF WEB-SHAPED MATERIAL WITH A SIGNAL-GENERATING MEANS

[76] Inventor: Thomas Lammers, Im Gewerbegebiet 7A, 26842 Ostrhauderfehn, Germany

[21] Appl. No.: 09/032,781

[22] Filed: Mar. 2, 1998

[30] Foreign Application Priority Data

May 2, 1997 [DE] Germany ..... 197 18 601

[51] Int. Cl.[6] ..... B65H 16/02

[52] U.S. Cl. ..... 187/141; 242/563

[58] Field of Search ..... 181/141; 84/95.2; 242/563, 912

[56] References Cited

U.S. PATENT DOCUMENTS 3,037,415 6/1962 Wyant .

5,884,861 3/1999 Hosomi et al. ..... 242/563

FOREIGN PATENT DOCUMENTS 68026 4/1914 Switzerland .

*Primary Examiner*—Khanh Dang

*Attorney, Agent, or Firm*—Hill & Simpson

[57] ABSTRACT

A roll of web-shaped material with a hollow roll core on which the web-shaped material is wound includes a signal-generating arrangement for generating an acoustical signal when the roll is rotated on a shaft as the web-shaped material is unwound therefrom and the signal-generating arrangement is part of the roll core.

18 Claims, 2 Drawing Sheets

ROLL OF WEB-SHAPED MATERIAL WITH A SIGNAL-GENERATING MEANS

BACKGROUND OF THE INVENTION

The present invention is directed to a roll of web-shaped material having a hollow roll core on which the web-shaped material is wound and which roll has a signal-generating means for generating an acoustical signal that is triggered when the roll is seated on a shaft and the web-shaped material is being unrolled therefrom.

Absorbent paper, such as toilet paper, paper towel and household papers, as well as packaging films, particularly aluminum or plastic foils, are regularly required for different purposes, particularly in the household and health field. These materials are usually present in a roll form, which is commercially obtainable. In order to facilitate the handling or, respectively, the removal of more or less short pieces of material from a continuous roll, a holder device for the roll having an arbor that carries the roll is usually present and the material is unrolled from this device.

Swiss Letters Patent CH-68026 discloses a device wherein an unrolling of toilet paper from a roll of toilet paper actuates a music box attached outside the roll. A similar device is disclosed by U.S. Pat. No. 3,037,415. Both of these devices obviously pursue the purpose of having a melody or, respectively, musical signal sound when the toilet paper is being unrolled. Since the device for making this sound is attached to the device for supporting the roll, it is not easily changed when changing the roll on the device for supporting the roll.

SUMMARY OF THE INVENTION

The object of the present invention is to generate an arbitrary acoustical signal when material is unrolled, wherein the audio or musical signal or even spoken words can convey a message, particularly for advertising purposes, and which preferably relates in meaning to an imprint potentially presented on the roll of material. Thus, the object is to enable different rolls of different materials to have different acoustical signals, which cannot be obtained with the prior known devices, in which the music playing means is permanently connected to the device supporting the roll in a dispenser and would have to be adapted to individual rolls with unacceptable cost.

Another object of the present invention is to improve the solutions disclosed in the prior art and to enable the individual acoustical signal to be generated for individual rolls. This is inventively achieved by the signal-generating means being integrated into the roll core to form a uniform overall part thereof.

As a result of this surprisingly simple and expedient combination of the roll and signal-generating means, a matching acoustical signal can be offered for each roll so that the signal will match the printed information on the material wound on the roll and the signal is generated in some form or other by a signal-generating means, which is suitably stored with the roll.

Preferably, the signal-generating means is situated inside the roll core. Alternatively, a cylindrical signal-generating means can be provided and serves as the roll core.

The signal can be at least partially composed of an audio or musical signal. At least partly, the signal can also be composed of spoken language. It is thus possible to carry practically any type of advertizing-related message more or less "multi-medially" to potential or actual customers in that, on one hand, the signal-generating means offers an arbitrary acoustical information and, on the other hand, the printing on the roll material offers optical information that is readable to the user.

The signal-generating means can be located inside an annular interspace between the roll core and a receptacle shaft of the unrolling means or dispenser device. This exploits the fact that most unrolling means comprise a usually stationary, acceptance arbor for the roll that is of a considerably smaller diameter than the inner diameter of the hollow roll core.

Preferably, the signal-generating means comprises two parts rotatable relative to one another, whereby one is connected to the acceptance shaft and the other is connected to the roll core. A triggering of the acoustical signal occurs in that upon unrolling, the two parts are rotated relative to one another and a suitable mechanical, electronic or optical means will occur.

One part of the signal-generating means can thus be connected to the acceptance shaft of the unrolling means either by frictional engagement or with a form fit.

It can be provided that the two parts rotatable relative to one another can only be turned by a specific rotational angle relative to one another so that a restoring spring that generates a backing force when the material is unrolled is arranged between the two parts.

The signal-generating means can comprise a mechanical sound or noise-generating means. For example, an acoustical bellows device can be present for generating the sound. Alternatively or in addition, the signal-generating means can comprise an electromagnetic sound carrier and a corresponding read and playback means.

In a preferred embodiment, the signal-generating means comprises a digital memory in which the acoustical signal is stored.

The signal-generating means can preferably be separated from the roll core or, respectively, from the roll of material without damaging one of the parts. A return, recycling, waste disposal or the like is thereby possible without problems.

The web-shaped material is preferably provided with printed information that is related in meaning to the acoustical signal. For example, an advertizing slogan can be printed on the material and trademark names relative to an illustrated product can be spoken. Also, melodies or jingles that are familiar to the purchaser and are associated with an advertisement for a specific product can be played while a picture of the product is printed on the roll material. Obviously, numerous combinations are conceivable.

The imprint is preferably an advertizing slogan that is played back in spoken or musical form by the signal-generating means.

The web-shaped material can be selected from a group consisting of a household paper, a toilet paper, a packing foil, an aluminum film and a plastic film.

The invention is also directed to a device for unrolling web-shaped material with an essentially cylindrical shaft for holding a roll of web-shaped material that is characterized by the inventive roll of the web-shaped material.

Other advantages and features of the invention will be readily apparent from the following description of the preferred embodiments, the drawings and claims.

DESCRIPTION OF THE PREFERRED EMBODIMENTS

Figure 1:
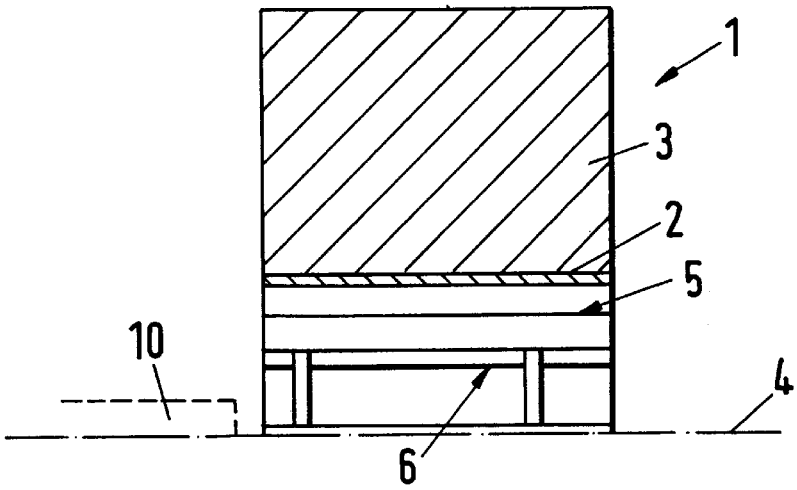
FIG. 1 is a schematic cross-sectional view of one-half of a roll having the integrated signal-generating means.
Figure 2:
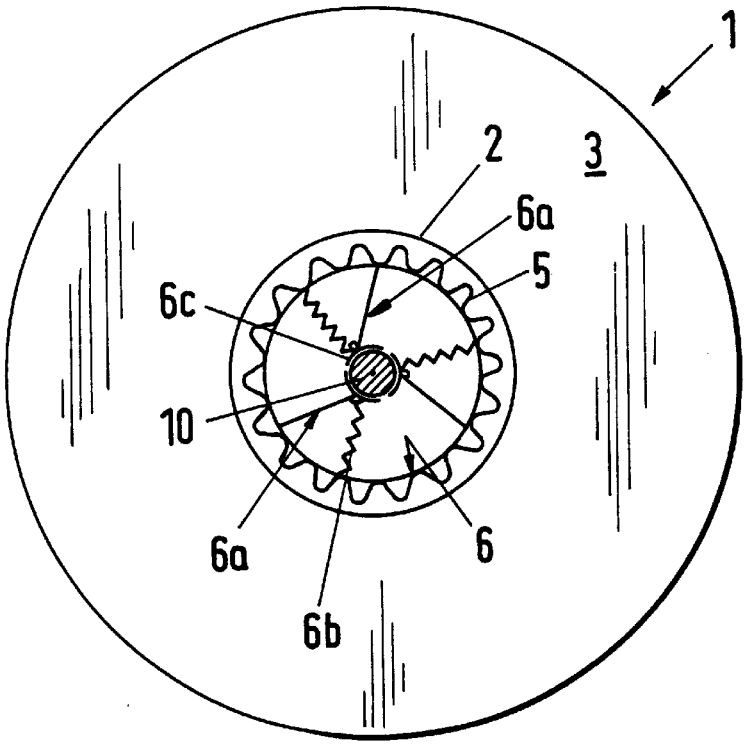
FIG. 2 is an end view of the roll of FIG. 1.

The principles of the present invention are particularly useful when incorporated in a roll, generally indicated at 1 in FIGS. 1 and 2. The roll 1 is composed, first, of a web-shaped material 3, which is wound on a roll core 2. The core 2 is of a tubular construction having an axially-extending cavity along an axis 4. The roll 1 is supported on an arbor 10 of a device for unrolling the material 3 and the arbor 10, which, as illustrated in FIG. 2, has a diameter substantially less than the inner diameter of the core 2.

A signal-generating means, as illustrated in FIGS. 1 and 2, is composed of an acoustical bellows device 5 that is inventively fashioned or arranged within the cavity formed by the roll core 2. An accordion-shaped or, respectively, wave-shaped bellows that is composed of a suitable air-tight material and is essentially fashioned dynamically balanced exhibits a radial spacing from the roll core 2 and, together with end face limitations, encloses an air volume therein. At its inside points facing toward the shaft or arbor 10, the bellows is connected to elastic braces 6 which proceed in a longitudinal and circumferential direction that form a force introduction point or, respectively, an attack point in order to pull the bellows in an inward radial direction toward the arbor 10 or, respectively, to press it radially outward toward the core 2. Given such a contraction or expansion of the bellows, the volume enclosed between the bellows and the roll core diminishes or enlarges and this results in a corresponding airstream out of or, respectively, into the volume. Such an airstream can be utilized in a known way for generating, for example, audio signals, noise or the like.

The conversion of the rotational motion of the roll 1 and the roll core 2 connected thereto into a described radial motion of the elastic braces 6 is explained and illustrated in FIG. 2. Two groups of flat coil springs 6*b* are arranged axially spaced within the roll core 2 and, together with the pressure plates 6*c*, produce a frictional connection of the braces 6 to a stationary acceptance arbor 10 of the dispenser device. Levers 6*a*, which are attached approximately in a radial direction to, first, the pressure plates 6*c* and, second, to the elastic braces 6, will create a radial motion of the braces 6 and, thus, of the accordion bellows 5 when the roll is turned relative to the arbor. The frictional connection to the acceptance arbor can, for example, be designed so that it will transmit the torque that leads to the desired motion of the bellows but slides through given further relative rotation of the roll so that damage to the mechanism is avoided.

Alternatively, it could be provided that the roll core 2 can be turned by only a specific rotational angle relative to the stationary acceptance arbor. A restoration is created by the springs which act after this specific amount of rotation. A detent that can be expedient for manipulation thereby will occur.

Figure 3:
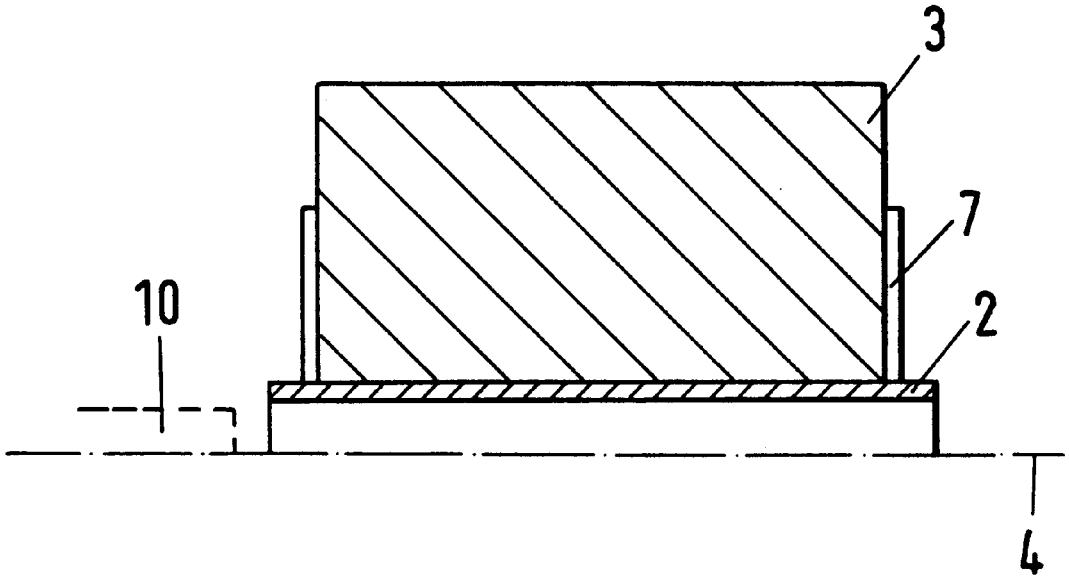
FIG. 3 is a schematic longitudinal cross-sectional view through one-half of an alternate embodiment of the inventive roll.

Another embodiment of the invention has a roll 3 (shown in FIG. 3) with a signal-generating means being integrated in the roll core 2 in the form of an electronic storage medium. An optical, electromagnetic or mechanical sensor (not shown) recognizes a rotation of the roll or, respectively, of the roll core 2 relative to a holding arbor and activates a signal-generating means. The acoustic playback of the signal in this exemplary embodiment occurs via a loudspeaker element 7 that is held laterally by the roll core in the illustration of FIG. 3, but it can also be attached to the inside of the core. The energy supplied for the signal-generating means occurs, for example, by a button-shaped battery or cell, for example a round cell R9 DIN40864.

Let it be noted that it is, in fact, expedient for the invention, but not compulsory, that the acceptance shaft or the holding arbor is held in a stationary manner, since recognition of an unrolling motion of the roll is also possible by other means.

It is preferably provided that the acoustical signal generated by the signal-generating means is related in meaning, in a way recognizable by a user, either directly with the unrolled material as an independent product or, on the other hand, with advertizing messages printed on the material. As a result of the simultaneous visual and acoustical perception of relative advertising messages as known, the perception and retention thereof is substantially enhanced, so that a very effective advertising arrangement can be achieved with the inventive roll.

Although various minor modifications may be suggested by those versed in the art, it should be understood that I wish to embody within the scope of the patent granted hereon all such modifications as reasonably and properly come within the scope of my contribution to the art.

I claim:

1. A roll of web-shaped material comprising a hollow roll core having a web-shaped material wound thereon, said core having a signal-generating means for generating an acoustical signal, which is triggered when the roll is seated on a shaft of a dispenser and the web-shaped material is unwound, said signal-generating means being integrated in the roll core.

2. A roll according to claim 1, wherein the signal-generating means is located inside the roll core.

3. A roll according to claim 1, wherein the signal-generating means is cylindrical and serves as the roll core.

4. A roll according to claim 1, wherein the signal is at least partially composed of a signal selected from an audio signal and a musical signal.

5. A roll according to claim 1, wherein the signal is partially composed of spoken language.

6. A roll according to claim 1, wherein the signal-generating means is located within an annular interspace between the roll core and a stationary acceptance shaft of a dispensing device.

7. A roll according to claim 1, wherein the signal-generating means comprises two parts rotatable relative to one another, wherein one part is in contact with an acceptance shaft of a dispenser and the other is connected to the roll core.

8. A roll according to claim 7, wherein the one part in contact with the acceptance shaft frictionally engages said shaft.

9. A roll according to claim 7, wherein the two parts rotatable relative to one another can only be turned by a specific rotational angle relative to one another, wherein a restoring spring that generates a backing force when the material is unrolled is arranged between the two parts.

10. A roll according to claim 1, wherein the signal-generating means is a mechanically-actuated signal-generating means.

11. A roll according to claim 10, wherein the signal-generating means comprises an acoustical bellows device.

12. A roll according to claim 1, wherein the signal-generating means comprises a magnetic sound carrier and a corresponding read and playback means.

13. A roll according to claim 1, wherein the signal-generating means comprises a digital memory in which an acoustical signal is stored.

14. A roll according to claim 1, wherein the signal-generating means is removably mounted in the roll core and can be separated therefrom without damaging the parts.

15. A roll according to claim 1, wherein a web-shaped material is provided with imprints that is related in meaning to the acoustical signal.

16. A roll according to claim 15, wherein the imprint is an advertising slogan that is related to the acoustical signal being generated.

17. A roll according to claim 1, wherein the web-shaped material is a material selected from a group consisting of a household paper, toilet paper, packaging foil, aluminum film and plastic film.

18. A device for unrolling a web-shaped material with a stationary acceptance shaft for holding a roll of web-shaped material, said roll having a roll core receiving the material and a signal-generating means for generating an acoustical signal being associated with the core so that movement of the core on said shaft causes a signal to be emitted from said signal-generating means.

* * * * *